US006336232B1

(12) United States Patent
Toder

(10) Patent No.: US 6,336,232 B1
(45) Date of Patent: Jan. 8, 2002

(54) SHOWER CURTAIN

(76) Inventor: Ellis I. Toder, 2000 Pioneer Rd., Huntingdon Valley, PA (US) 19006

( * ) Notice: Subject to any disclaimer, the term of this patent is extended or adjusted under 35 U.S.C. 154(b) by 0 days.

(21) Appl. No.: 09/567,609

(22) Filed: May 10, 2000

(51) Int. Cl.[7] ..... A47K 3/38
(52) U.S. Cl. ..... 4/608; 4/558
(58) Field of Search ..... 4/558, 608, 599, 4/600, 602; 160/330, 349.1; 134/117

(56) References Cited

U.S. PATENT DOCUMENTS

| | | | | | |
|---|---|---|---|---|---|
| 1,545,093 | A | * | 7/1925 | Gallob | 4/608 X |
| 2,687,170 | A | * | 8/1954 | Johnson | 160/330 |
| 2,771,945 | A | * | 11/1956 | Wittrup | 4/608 X |
| 3,000,016 | A | * | 9/1961 | Ridge | 4/608 X |
| 3,107,361 | A | * | 10/1963 | Glutting | 4/558 |
| 4,594,741 | A | * | 6/1986 | Payne | 4/608 X |

* cited by examiner

*Primary Examiner*—Charles E. Phillips

(74) *Attorney, Agent, or Firm*—Michael F. Petock, Esq.

(57) ABSTRACT

A shower curtain useable with a shower stall that does not include a front sill or wall of the type that normally cooperates with a shower curtain or shower door to seal the front opening into the shower stall. The shower curtain includes a flexible sheet member 12 that is attachable in an upper region thereof to an upper supporting member adjacent the front opening into the shower stall to permit movement of the flexible sheet member 12 between an extended orientation closing the front opening and a collapsed orientation permitting access into the shower stall through the front opening. Elongate side regions or panels of the sheet member include fastening members for cooperating with fastening members on adjacent side walls of the shower stall to close the opposed sides of the front opening into the shower stall. Weights disposed transversely along the lower region of the sheet member being spaced upwardly from a lower bottom panel of the sheet member intended to engage the floor of the shower stall. Most preferably a moveable panel section is provided in the front panel of the shower curtain and this panel section can be at least partially separated from adjacent regions of the curtain to provide communication between the inside and outside of a shower stall when the curtain is in its extended orientation closing the front opening into the shower stall.

26 Claims, 4 Drawing Sheets

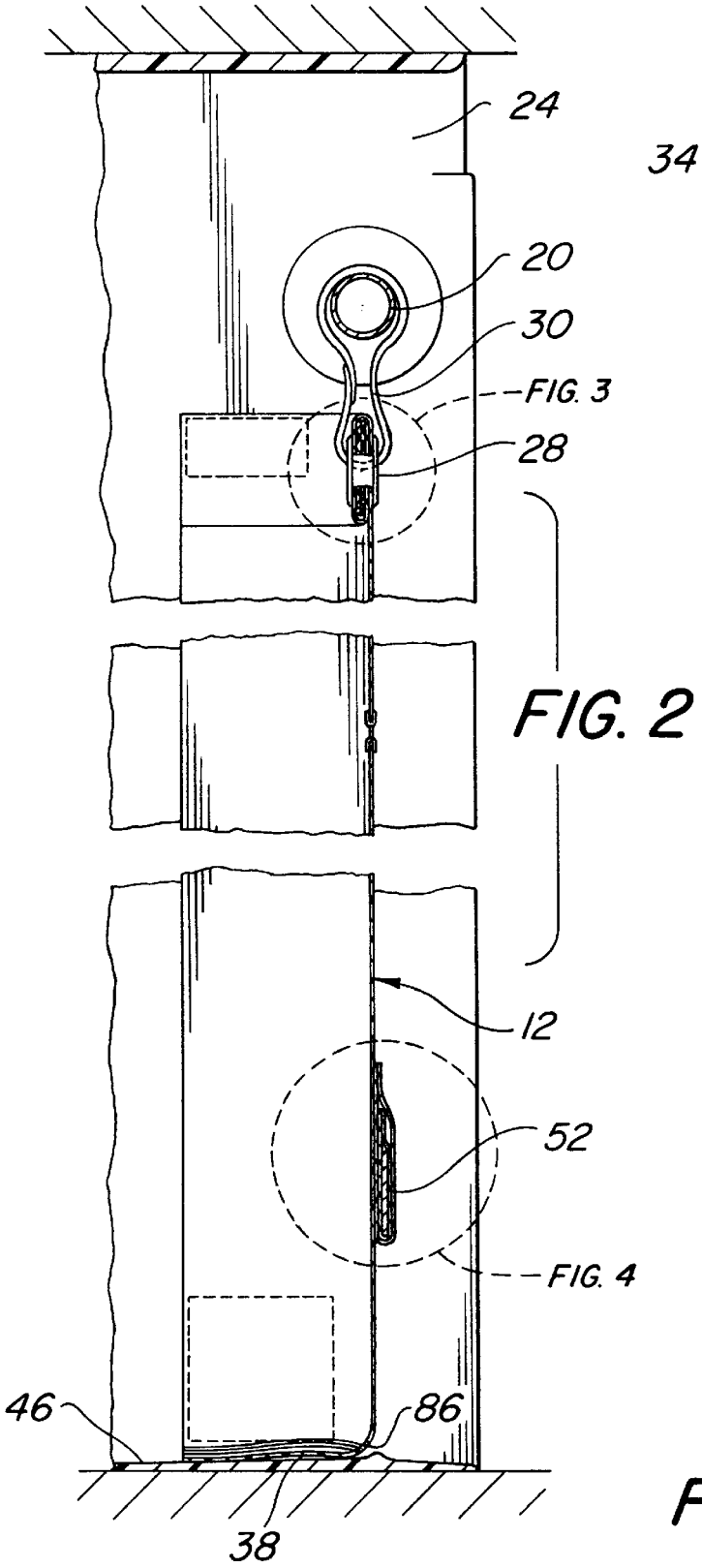
FIG. 2
FIG. 3
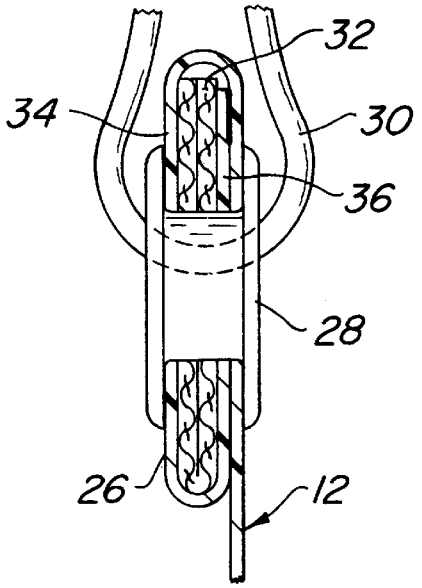
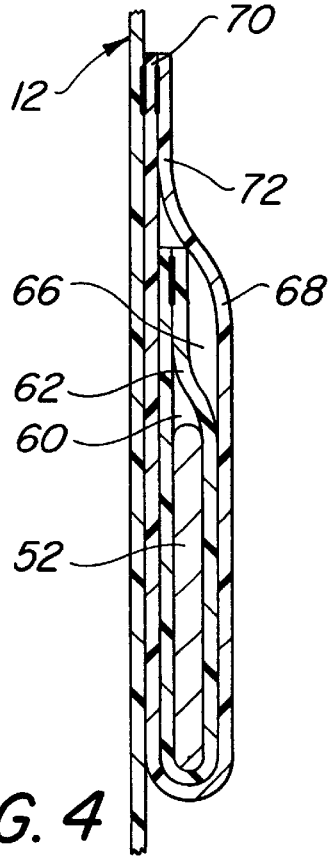
FIG. 4

SHOWER CURTAIN

BACKGROUND OF THE INVENTION

Conventional shower stalls typically include opposed side walls, a back wall and a low front wall, typically referred to as a front sill. The low front wall or sill serves as a water barrier at the floor level of the shower stall to preclude water from running out of the stall. A shower door or curtain typically cooperates with the front sill to enclose the front opening into the shower stall to thereby prevent water from splashing out of the stall.

Although prior art shower stall installations including a low front sill cooperating with a shower door or curtain do work well to retain water within the stall, these shower stall designs are not well suited for use by handicapped individuals that find it difficult to step over the front sill into the shower stall. These shower stalls clearly can not be used easily by individuals confined to a wheelchair and that need to remain in the wheelchair while taking a shower.

It is highly desirable to design shower stalls for handicapped people such that there is no front wall or sill that provides an obstacle to the person entering the stall. In other words, in a preferred shower stall design for use by handicapped individuals there should be a clear, unobstructed path from the floor region located outside of the stall onto the floor of the stall. Although these latter shower stalls can be used by handicapped individuals, including individuals that are confined to wheelchairs, there has not been a truly satisfactory design for effectively sealing the front opening into the stall to prevent the undesired escape of water therefrom. This invention is directed to a shower curtain for achieving this latter objective.

In addition, handicapped individuals taking a shower often require assistance from an attendant, who preferable will remain outside of the shower stall to provide such assistance when and as it is required. In order to provide the individual taking a shower with the desired privacy, and also to eliminate the need for the attendant to directly enter the stall while the individual is showering to provide assistance, it is highly desirable to permit the attendant to access the interior of the stall from an outside region without permitting excess water from flowing or splashing out of the stall. The present invention provides a convenient access opening in the curtain to accomplish this latter objective.

OBJECTS OF THE INVENTION

It is a general object of this invention to provide a shower curtain that is particularly adapted for use in enclosing a front opening into a shower stall of the type that does not include a low front wall or sill.

It is yet a further object of this invention to provide a shower curtain that effectively seals the opening into a shower stall, even if the shower stall does not include a low front wall or sill.

It is still a further object of this invention to provide a shower curtain that is neat in appearance and easy to use.

It is yet a further object of this invention to provide a shower curtain that permits easy access through it to permit an attendant located outside of the stall to assist an individual taking a shower.

SUMMARY OF THE INVENTION

The above and other objects of this invention are achieved by a shower curtain including a flexible sheet member having a transversely extending upper edge, a transversely extending bottom edge and opposed elongated side edges. The flexible sheet member is attached in an upper region adjacent to the upper edge thereof to an upper supporting member adjacent a front opening of the shower stall for movement between an extended, generally planar orientation closing the front opening into the stall, and a collapsed, generally folded orientation permitting access into the shower stall through the front opening thereof. Elongate side regions or panels of the sheet member adjacent to the elongate side edges include fastening members along an elongate section thereof for cooperating with fastening members on the opposed sidewalls of the shower stall to thereby close the opposed sides of the front opening into the shower stall. The fastening members on the elongate side panels are on the outside surface, thereby being disposed to cooperate with the fastening means on the side walls of the shower stall. Weights are disposed transversely along a lower region of the sheet member, and the sheet member includes a lower, inwardly directing transversely extending bottom panel spaced below the weights for engaging the floor of the shower stall. In the preferred embodiment of this invention the vertical distance between the transversely extending center line of the weights and the transversely extending bottom edge of the sheet material is at least four inches, with the distance between the transversely extending center line of the weights and the floor of the shower stall being no greater than two inches. In this manner, it is assured that the bottom panel of the sheet member, will actually lie flat on the shower floor to provide an effective water seal at the floor level of the stall.

In the preferred embodiment of this invention the weights are disposed transversely along the sheet material and terminate at opposed transverse ends spaced inwardly from the opposed elongate side edges of the sheet material, such that each of the elongate side regions or panels of the sheet material that includes the fastening members thereon have a transverse dimension extending substantially from one of the transverse ends of the weights to an adjacent elongate side edge of the flexible sheet material. In a preferred embodiment of this invention, the transverse direction of each of the elongate side regions is at least two inches, and more preferably at least three inches.

In the preferred embodiment of this invention, the weights that are disposed transversely along a lower region of the sheet material include a plurality of discrete members spaced transversely along the lower region of the sheet material, thereby permitting the sheet material to fold in regions between adjacent weights when the curtain is moved into a collapsed orientation to permit an individual to enter a shower stall from the front opening thereof.

In the most preferred embodiment of this invention, the weights are retained in a transversely extending passageway of an elongate, tubular weight-retaining housing that is attached to the flexible sheet member of the curtain, with the passageway being sealed at its opposed ends and with the regions between the weights being sealed to maintain the weights in their desired positions. Most preferably the tubular weight-retaining housing is retained within an elongate, transversely extending passageway of a second, outer housing, with the passageway in the second outer housing being sealed at its opposed ends and with said outer housing being directly secured to the front panel of the sheet member of the curtain to thereby attach the weights to the flexible sheet member. In the most preferred embodiment of this invention the outer housing is secured to the sheet member by being bonded thereto along a transversely extending, upper region of said outer housing.

In the most preferred form of the invention the upper region of the sheet member includes a row of transversely spaced apart openings therethrough for receiving members attachable to, or attached to the upper supporting member for the shower curtain, with the transversely spaced apart openings in the row being vertically offset from the spaces between the weight members. Moreover, the end openings of the row are spaced inwardly from the elongate side edges of the sheet material so as not to be located in the elongate side regions or panels of the sheet member.

In accordance with another aspect of this invention the flexible sheet member forming the shower curtain includes a panel section that can be at least partially separated from adjacent regions of the sheet member to provide communication between the inside and outside of a shower stall when the curtain is in an extended, generally planar orientation closing the front opening into the shower stall.

Most preferable the panel section is connected to adjacent regions of the sheet member by at least one fastening device that is operable both to secure the panel section to adjacent regions of the sheet member, and thereby completely seal the front opening into the shower stall, and to at least partially separate the panel section from the adjacent regions of the sheet material to permit at least limited access into the shower stall from a region outside of the stall. In the most preferred embodiment of this invention at least two fastening devices are employed and these fastening devices are most preferably zipper members.

In the most preferred embodiment of this invention the panel section can be separated from adjacent regions of the front panel of the shower curtain along opposed side regions and a top region of said panel section, said panel section including a bottom region permanently secured to the front panel of the shower curtain, and actually constituting a continuous extension of each front panel. In this preferred embodiment, one of the zipper members is moveable in a downward direction from the top of one of the opposed side regions to the bottom region, and the other of the zipper members is moveable in a downward direction from the top of the other of the opposed side regions to the bottom region. Moreover, at least one of the zipper members is moveable into a region for both fastening and separating the top region of the panel section to adjacent regions of the sheet member. In this manner the two zippers can be employed either to only partly open the panel section, or to completely open the panel section, as is desired.

BRIEF DESCRIPTION OF THE DRAWING

Other objects and many attendant features of this invention will become readily appreciated as the same becomes better understood by reference to the following detailed description when considered in connection with the accompanying drawings wherein:

FIG. 2 is a sectional view taken along line 2—2 of FIG. 1;

FIG. 3 is an enlarged view of the circled area identified as "FIG. 3" in FIG. 2;

FIG. 4 is an enlarged view of the circled area identified as "FIG. 4" in FIG. 2;

DESCRIPTION OF THE PREFERRED EMBODIMENT OF THE INVENTION

Figure 1:
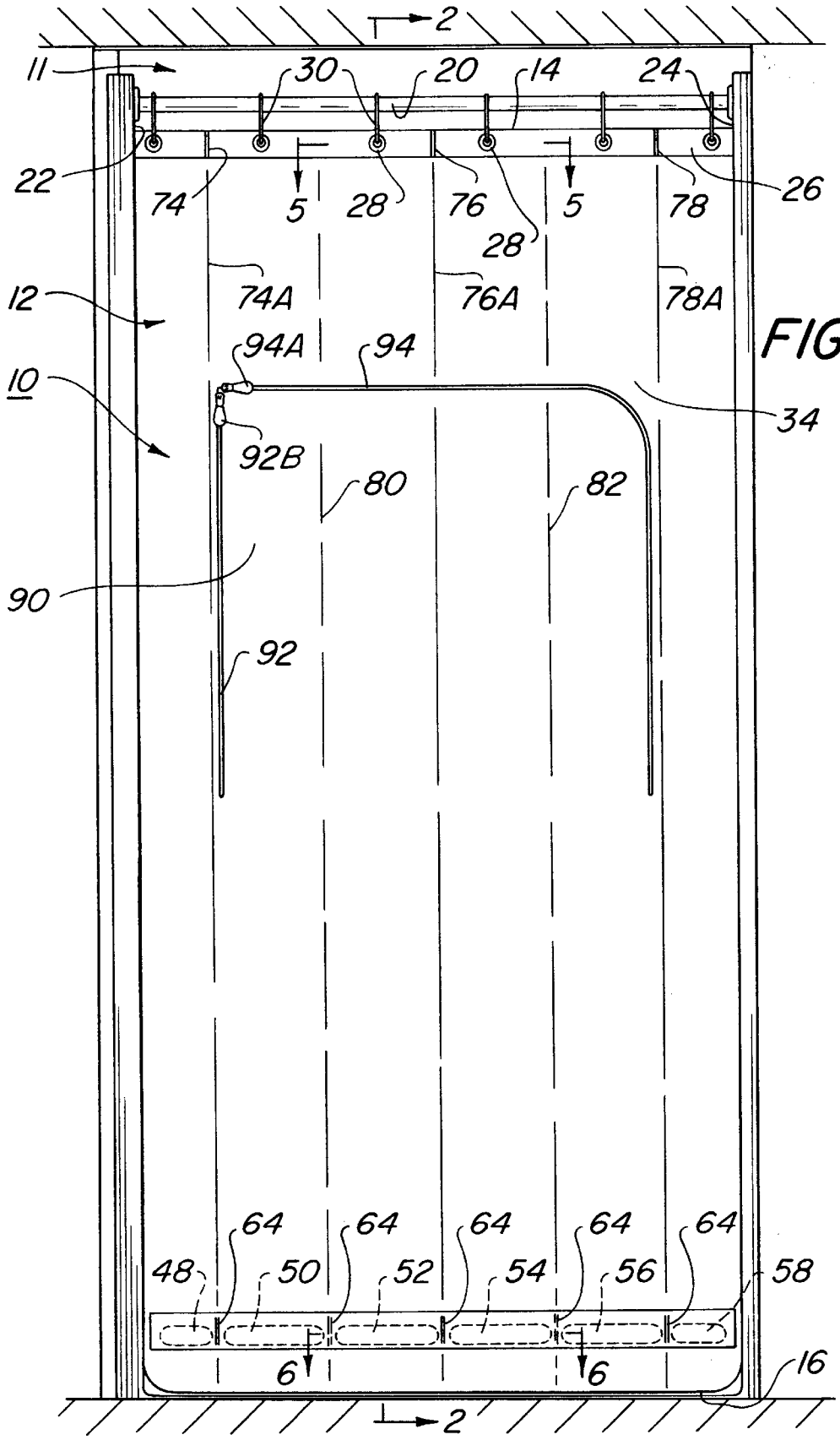
FIG. 1 is a front elevational view of a shower curtain embodying the present invention.
Figure 8:
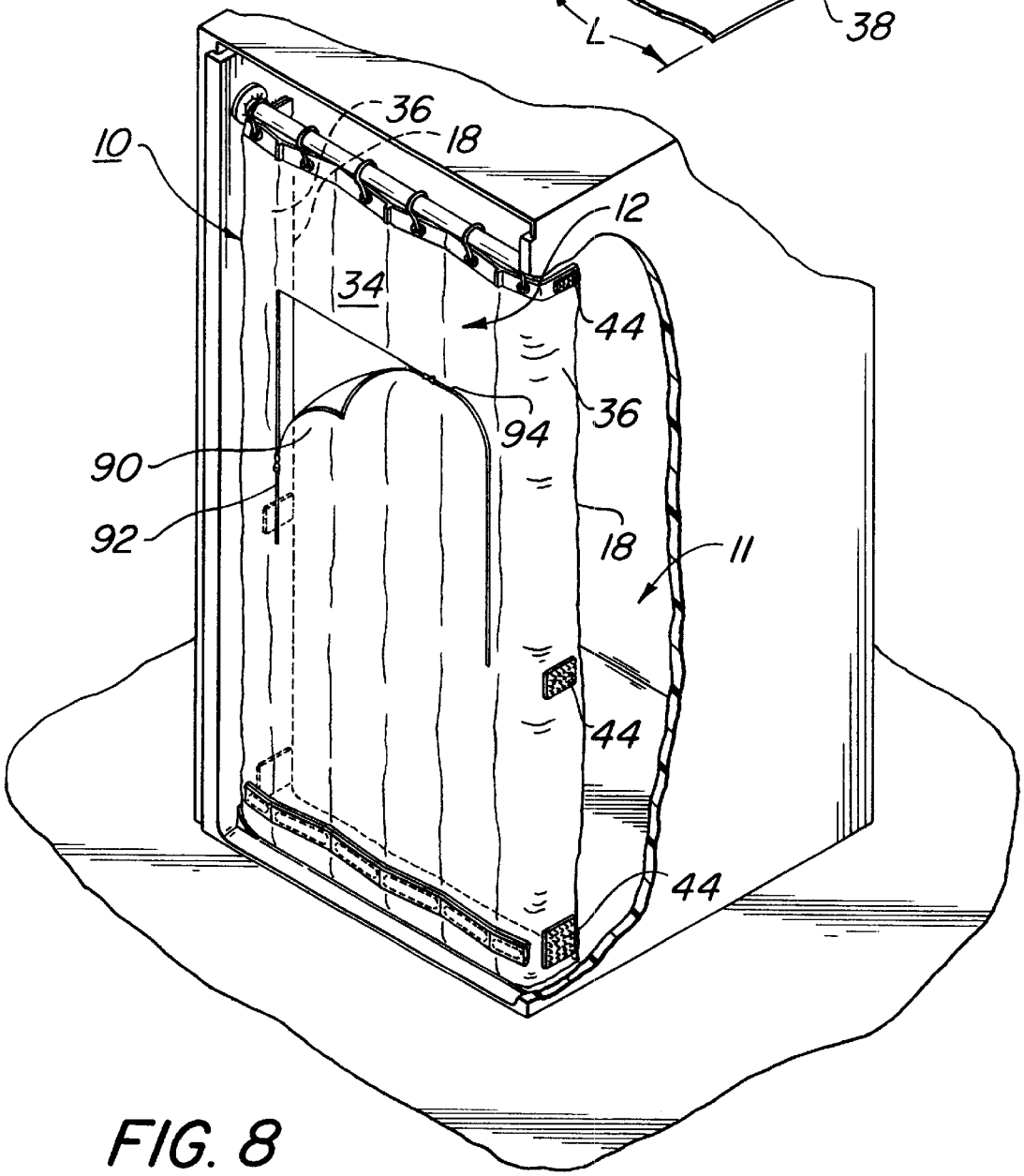
FIG. 8 is an isometric view of a shower curtain embodying the present invention showing its relative position to a shower stall.

Referring to the drawings, a shower curtain embodying the features of this invention is shown generally at 10 in FIGS. 1 and 8.

Figure 6:
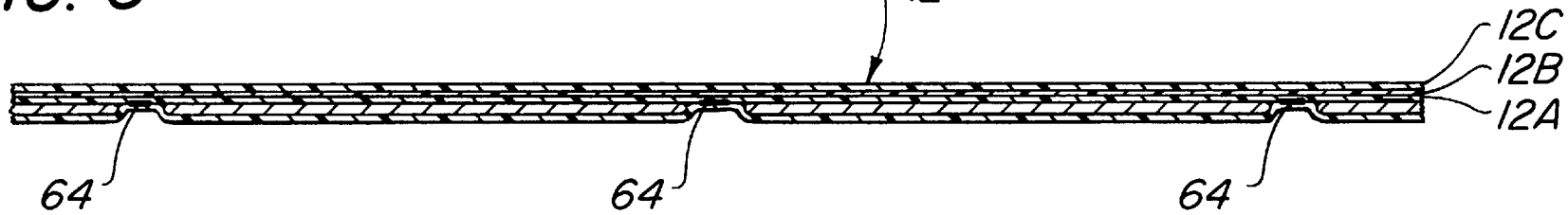
FIG. 6 is a sectional view taken along line 6—6 of FIG. 1.

Referring to FIGS. 1 and 8, the shower curtain includes a flexible sheet member 12 of any desired fabric or material provided that it has sufficient durability to function as a shower curtain. In a preferred embodiment of this invention the flexible sheet member is made of a vinyl material and most preferably, is a three layer laminate including outer vinyl layers 12A of approximately 3½ mil thickness and a central polyester mesh layer 12B. (See FIG. 6) As will be explained in greater detail hereinafter, the shower curtain 10 is particularly adapted for use with a shower stall 11 that is handicap accessible, e.g., a shower stall that does not include a low front wall to impede entry by handicapped individuals; even handicapped individuals that are relegated to a wheelchair.

As can be seen best in FIGS. 1 and 8, the flexible sheet member 12 includes a transversely extending upper edge 14, a transversely extending bottom edge 16 and opposed elongate side edges 18. (See FIG. 8)

In the illustrated embodiment a transverse rod is connected to opposed side walls 22, 24 of the shower stall 11 to provide a support for the shower curtain 10. An upper region 26 of the flexible sheet member 12 adjacent the upper edge 14 includes a plurality of grommets 28 of a conventional construction for receiving hooks 30 or other fastening means therethrough.

As can be seen best in FIGS. 1, 2 and 8, these hooks 30 extend through the grommet 28 and about the supporting rod 20.

As can be seen best in FIG. 3, the upper region 26 of the flexible sheet member 12 is reinforced by folding the sheet member upon itself to form a three layer structure. In addition, a stiffening woven mesh 32 is disposed between the innermost layer 34 and intermediate layer 36 in the upper region 26. It should be understood that any desired arrangement can be provided for stiffening the upper region; the specific construction of the upper region not constituting a limitation on the broadest aspects of the present invention. For example, depending upon the strength of the flexible sheet member 12 it may be possible to eliminate the woven mesh 32. Also, it may be possible to provide a single fold of the sheet material only along upper edge 14 to provide only a two layer upper region, with or without an additional stiffening mesh, e.g. 32.

Referring specifically to FIGS. 1, 2,7 and 8, the flexible sheet member 12 includes a front panel 34, which encloses the front opening into the shower stall when in an extended, generally planar orientation, and elongate side regions or panels 36 disposed between the front panel 34 and the elongate side edges 18 of the sheet member 12 to seal against the side walls 22, 24 of the shower stall 11, in a manner to be described in detail later in this application.

Figure 7:
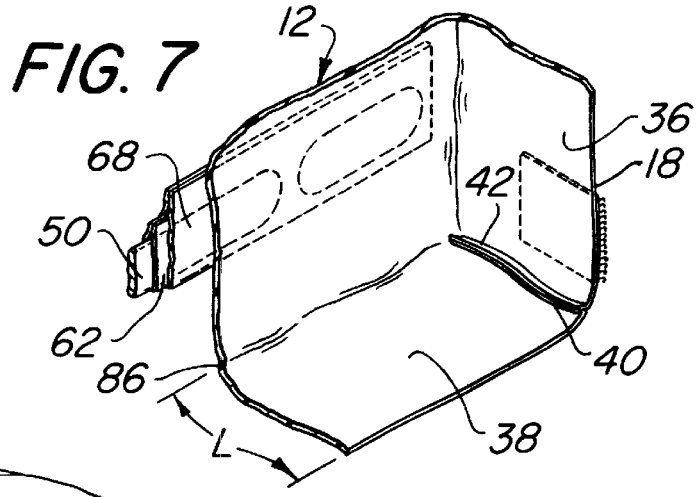
FIG. 7 is a fragmentary isometric view of the lower right inner corner of the shower curtain embodying this invention.

Referring specifically to FIGS. 2, 7 and 8, the flexible sheet member 12 also includes a lower, generally horizontal bottom panel 38, which extends inwardly of the shower stall 11 and aids in providing a barrier to prevent water from splashing out of the shower stall under the bottom of the shower curtain 10.

The inwardly directed bottom panel 38 and the inwardly directed opposed side panels 36 are formed by initially forming the flexible sheet member 12 with a bottom panel segment having a generally vertical dimension corresponding to the inwardly directed horizontal dimension "L" of the panel in the completed curtain 10, and a transverse dimension between transversely spaced apart edges 40 (only one of which is shown in FIG. 7) terminating short of the elongate side edges 18 of the front panel 34 of the curtain 10. The elongate side panels 36 and inwardly directed bottom panel 38 are formed by folding the bottom panel segment upwardly and the side panel sections inwardly and then stitching the confronting ends of the bottom panel segment to the lower edges of the side panel sections; one of said stitched regions being shown at 42 in FIG. 7.

Referring to FIGS. 2 and 8, each of the side panels 36 is provided with spaced apart fastening members 44. In the illustrated embodiment there are three fastening members on each side panel 36; one fastening member being adjacent the bottom edge 16 of the flexible sheet member 12, a second fastening member being located in the reinforced upper region 26 of the side panel and a third fastening member being located generally in a central region of the side panel, between the upper and lower edges 14 and 16 of the flexible sheet member 12. However, the number and location of the fastening members can be varied.

In the illustrated embodiment, the fastening members 44 attached to the side panels 36 are male or female fasteners of a Velcro fastening system, with the mating (e.g., female or male) fastening members being secured to the opposed side walls 22, 24 of the shower stall 11. It should be understood that, in accordance with the broadest aspects of the invention, other fastening members may be employed, such as cooperating magnets.

Referring specifically to FIGS. 1, 2,4 and 6 through 8, the shower curtain 10 of this invention employs a unique weighting system to aid in maintaining the inwardly directed bottom panel 38 adjacent the floor 46 (FIG. 2) of the shower stall 11 to provide an effective dam or barrier area for water being ejected out of the shower head.

Referring to FIGS. 1, 4 and 8, in the illustrated embodiment the shower curtain 10 includes six (6) discrete elongate weight members 48, 50, 52, 54, 56 and 58. The four (4) central weight members 50,52, 54 and 56 are approximately six (6) inches long and each weighs approximately 3.3 ounces. The two (2) end weights 48, 58 are approximately three (3) inches long and each weighs approximately 1.65 ounces. As can be seen best in FIG. 4, the individual weights are disposed in a transversely extending passageway 60 of an elongate, tubular weight-retaining housing 62. The housing 62 can be made of any desired material, such as a vinyl material, and the passageway 60 preferably is sealed in the regions between the weight members and at the opposed ends by stitching 64, or by any other suitable means to maintain the discrete weight members in a desired fixed position relative to each other. Stitching 64 is an acceptable means for sealing the passageway 60 in the internal tubular weight-retaining housing 62, since this internal housing is not exposed to scum and other foreign debris encountered by the shower curtain 10.

Still referring to FIGS. 2, 4 and 7, the inner tubular housing 62 that includes the weights therein is disposed within an elongate, transversely extending passageway 66 of an outer housing 68 that also can be made of a vinyl material or any other desired material. The passageway 66 in the outer housing 68 preferably is sealed at opposed ends 70, 72 by a suitable bonding mechanism, such as a dielectric heat sealing operation, and the outer housing is directly secured to the flexible sheet member 12 of the curtain along the upper elongate edge thereof to thereby positively attach the weights 48–58 to the flexible sheet member 12. In the preferred embodiment the outer housing is attached to the sheet member along the upper elongate edge thereof by a suitable electronic heat sealing operation, e.g., dielectric heating. This heat sealing mechanism is highly desirable for use in bonding vinyl material to itself. Thus, when the outer housing 68 and the flexible sheet member 12 of the curtain 10 are both vinyl, a dielectric heating operation is highly effective to establish the connection of the weights to the shower curtain.

Referring specifically to FIGS. 1 and 8, it should be noted that the weights are provided only on the front panel 34 of the shower curtain 10, and do not extend into the region of the side panels 36. In fact, in the preferred embodiment of this invention the width of each of the side panels 36 corresponds essentially to the distance between the distal edge of the outermost weights 48, 58 and the corresponding side edges 18 of the flexible sheet member 12.

Figure 5:
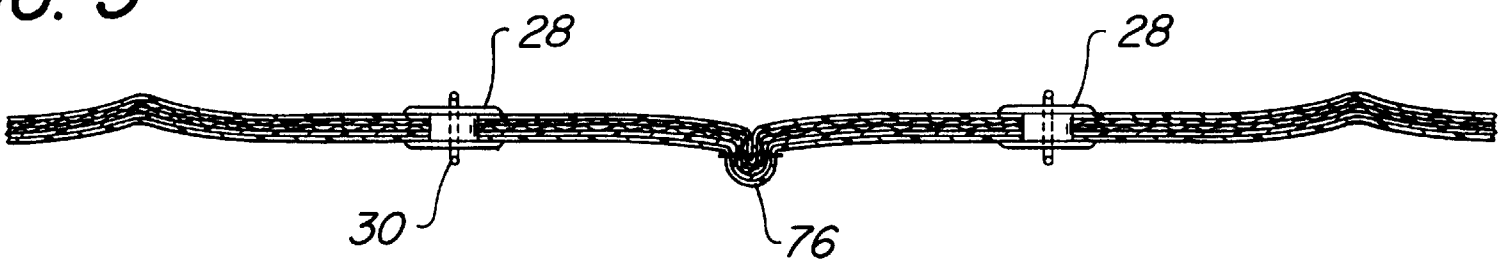
FIG. 5 is a sectional view taken along line 5—5 of FIG. 1.

Referring specifically to FIGS. 1, 5, 6 and 8, the shower curtain 10 is designed so as to permit the flexible sheet member 12 to collapse in regions between the grommets at the upper region 26, and in regions between the individual weight members adjacent the bottom region thereof. Specifically, to create the desired regions of outward folds in the shower curtain the shower curtain is puckered at 74, 76 and 78 midway between alternate pair of grommets 28, by stitching the material together, as is best seen in FIG. 5. These puckered regions provide a force-concentrating section to cause the flexible sheet member 12 to fold outwardly thereat along fold lines 74A, 76A and 78A (FIG. 1). This causes unpuckered regions of the flexible sheet member 12 between alternating pairs of grommets to fold inwardly along fold lines 80 and 82 (FIG. 1). As is seen best in FIG. 1, the fold lines, in all cases, are in the regions between the adjacent weights (also see the relationship between the fold lines and weights in FIGS. 5 and 6).

It also should be noted that, in the preferred embodiment of this invention, there are no grommets provided in the upper region 26 of the side panels 36 of the flexible sheet member 12. This is important since the side panels are required to be flexible so that they can be bent inwardly and be attached to the opposed side walls 22, 24 of the shower stall 11, to thereby provide an effective dam for water directed into the stall from the shower head.

In a preferred embodiment of this invention, the width of each of the side panels 36 is at least 2 inches, and most preferably is in the range of 2½ to 4 inches, and the unconstrained distance between the horizontal transverse center line of the weights and outer edge 86 (FIGS. 2 and 7) of the bottom panel 38 is approximately 4 inches. However, the distance between the horizontal transverse center line of the weights and the floor 46 of the shower stall 11 is less than the unconstrained distance between the transverse center of the weights and the outer edge 86 of the bottom panel (e.g., approximately 2 inches), to thereby provide assurance that the weighted lower region of the shower curtain will cause the bottom panel 38 to seat against the floor of the shower stall to provide an effective dam against the escape of water from the stall.

Referring specifically to FIGS. 1 and 8, an additional feature in accordance with a preferred embodiment of this invention is that the shower curtain 10 is designed to permit access to the inside of the stall 11 by an attendant located outside of the stall. In particular, there are often situations in which a handicapped person taking a shower requires some assistance, which can be rendered from a location outside of the shower. In prior art systems it was necessary to retract the shower curtain in order for an attendant to gain access to the patient. With the shower curtain retracted, it is very easy for water to escape from the shower stall; excessively wetting the attendant as well as areas outside of the stall.

In accordance with a preferred embodiment of this invention, the front panel 34 of the flexible sheet member 12 includes a separable panel section 90 that can be partially separated, or opened, from adjacent regions of the front panel to provide communication between the inside and outside of the shower stall 11 when the curtain is in an extended, generally planar orientation closing the front opening into the stall.

As can be seen best in FIGS. 1 and 8, the panel section 90 is removably connected to adjacent regions of the front panel 34 through a generally inverted U-shaped connection area by a pair of fastening means; preferably in the form of zippers 92, 94. As is illustrated, the panel section 90 includes a bottom region permanently joined to the front panel 34; actually constituting a continuous extension of the front panel 34 in this region. The panel section 90 has edges that can be separated from adjacent edges of the flexible sheet member 12 by movement of the zippers 92, 94 along opposed sides defining the legs of the inverted U-shaped connection area and along the top, constituting the base of said connection area.

As can be seen best in FIG. 1, one of the zippers 92 has a linear path of travel along one side edge, and the other zipper 94 has an L-shaped path of travel along atop edge and opposed side edge of the separable panel 90. The zippers 92, 94 are constructed so that they close, or secure the panel section 90 to adjacent edges of the flexible sheet member 12 when the head or gripping ends of the zippers 92A, 94A, respectively, are adjacent to each other at a corner, where one of the legs of the inverted U-shaped connection area joins the base thereof, as shown in FIG. 1. This arrangement of the zippers permits the panel section to be only partially opened, as desired. For example, if it is desired to only open the panel halfway, the linear zipper 92 is unzipped halfway down the linear leg and the L-shaped zipper 94 is unzipped along the entire top edge of the panel section 90 and down one half of the opposed leg. This permits one-half of the panel section 90 to be opened. FIG. 8 shows the linear zipper number 92 unzipped slightly more than one-half of its linear extent of travel, and the L-shaped zipper 94 in an intermediate position partially unzipped from the top edge of the panel section 90.

Without further elaboration, the foregoing will so fully illustrate our invention that others may, by applying current or future knowledge, readily adapt the same for use under various conditions of service.

I claim:

1. A curtain particularly adapted for use in enclosing a front opening into a shower stall of the type having opposed side walls, a floor and omitting a low front sill or wall of the type that normally cooperates with a shower curtain or shower door to seal the front opening into the shower stall, said curtain including a flexible sheet member having a transversely extending upper edge, and opposed elongated side edges, side flexible sheet member being attachable in an upper region adjacent the upper edge to an upper supporting member adjacent the front opening into the shower stall for movement between an extended, generally planar orientation closing the front opening and a clasped, generally folded orientation permitting access into the shower stall through the front opening, said flexible sheet member including a front panel and elongate side regions on opposed sides of said front panel, said elongate side regions extending rearwardly and including fastening members along an elongate section thereof for cooperating with fastening members on the opposite side walls of the shower stall to close opposed sides of the front opening, weights disposed transversely along a lower region of the sheet member, said sheet member including a lower bottom panel spaced below the weights in the region of said front panel, said bottom panel extending rearwardly, said rearwardly extending bottom panel and said rearwardly extending elongate side regions being joined together adjacent edges thereof.

2. The curtain of claim 1, wherein said sheet material includes opposed inner and outer surfaces, said outer surface facing out of the shower stall, said fastening members along the elongate section of the elongate side regions of the sheet material being on the outer surface thereof.

3. The curtain of claim 1, wherein said weights terminate at opposed transverse ends spaced inwardly from said opposed elongate side edges of said sheet member, each of said elongate side regions having a transverse dimension substantially from one of such transverse ends of the weights to an adjacent elongate side edge of the flexible sheet member.

4. The curtain of claim 3, wherein said transverse dimension from each of said one of said transverse ends of the weights to said adjacent elongate side edge of the flexible sheet member is at least 2 inches, and wherein a transversely extending center line of said weights is spaced upwardly from the lower bottom panel of the sheet member at least 2 inches.

5. The curtain of claim 3, wherein the weights include a plurality of discrete weight members spaced transversely along the lower region of the sheet member, wherein the sheet member being folded in regions between adjacent weight member when the curtain is in said collapsed orientation.

6. The curtain of claim 5, wherein said upper region of the sheet member includes transversely spaced-apart openings therethrough for receiving members attachable to, or attached to said upper supporting member, said transversely spaced-apart openings being vertically offset from the spaces between the weight members.

7. The curtain of claim 5, wherein said plurality of discrete weight members are disposed in a transversely extending passageway of an elongate, tubular weight-retaining housing attached to the flexible sheet member, said passageway being sealed in regions between the weight members to maintain the discrete weight members in the desired positions.

8. The curtain of claim 7, wherein said tubular weight-retaining housing is located within an elongate, transversely extending passageway of an outer housing, the passageway in said outer housing being sealed at opposed ends and said outer housing being directly secured to the sheet member to thereby attach the weights to said flexible sheet member.

9. The curtain of claim 8, wherein said outer housing is directly secured to the sheet member by being bonded thereto.

10. The curtain of claim 9, wherein said outer housing is bonded to the sheet member along a transversely extending, upper region of said outer housing.

11. The curtain of claim 1, wherein said flexible sheet member includes a panel section that can be at least partially separated from adjacent regions of said sheet member to provide communication between the inside and outside of a shower stall when the curtain is in an extended, generally planar orientation closing the front opening into the shower stall.

12. The curtain of claim 11, wherein the panel section is connected to adjacent regions of the sheet member by at least one fastening device that is operable both to secure the panel section to adjacent regions of the sheet member and to at least partially separate the panel section from said adjacent regions of said sheet material.

13. The curtain of claim 12, including two fastening devices, both of said fastening devices being zipper members.

14. The curtain of claim 13, wherein the panel section can be separated from adjacent regions of said sheet member along opposed side regions and a top region of said panel section, said panel section including a bottom region permanently joined to said sheet member, one of said zipper members being moveable in a downward direction from the top of one of said opposed side regions to the bottom region to separate said one of said opposite side regions from adjacent regions of said sheet members and the other of said zipper members being movable in a downward direction from the top of the other of said opposed side regions to the bottom region to separate said other of said opposed side regions from adjacent regions of said sheet member, at least one of said zipper members also being moveable into a region for fastening the top region of the panel section to adjacent regions of the sheet member and for separating the top region of the panel section from adjacent regions of the sheet member, whereby said zipper members can at least partially separate the panel section from adjacent regions of the sheet member along the opposed side regions and top region of said panel section.

15. The curtain of claim 14, wherein said opposed side regions and top region are linear regions defining a generally inverted U-shaped configuration with the opposed linear side regions constituting the legs of the inverted U and the linear top region constituting the base of the inverted U, one of said zipper members being a substantially linear member moveable in opposite linear directions from each end of one of said linear side regions to the opposed end of said one of said linear side regions, and the other of said two zipper members being a substantially L-shaped member moveable in opposite linear directions in both a first linear path along the linear top region and a second linear path along said other of said linear side regions.

16. The curtain of claim 15, wherein movement of said substantially linear zipper member along one linear side region in a direction from the top region downwardly separates the panel section from adjacent regions of the sheet member, and movement of the L-shaped zipper member in a direction across the top region and downwardly along said other linear side region separates the panel section from adjacent regions of the sheet member along the top region and said other linear side region of such panel section.

17. A curtain for closing a front opening of a shower stall, the curtain including a flexible sheet member moveable between an extended orientation for closing the front opening and a collapsed orientation for opening the front opening, said flexible sheet member including a moveable panel section that can be separated from adjacent regions of said sheet member along top and opposed side regions of said panel section to provide communication between the inside and outside of a shower stall when the curtain is in said extended orientation closing the front panel into the shower stall, said panel section including a bottom region permanently joined to said sheet member about which said panel section is moveable to provide said communication between the inside and outside of the shower stall, wherein said panel section can be separated from adjacent regions of said sheet member by at least partially opening two fastening devices that are operable to secure the panel section to adjacent regions of the sheet member and to separate the panel section from said adjacent regions of said sheet member, one of said fastening devices being openable in a downward direction from the top of said opposed side regions to the bottom region to separate said one of said opposite side regions from adjacent regions of said sheet member and the other of said two fastening devices being openable in a downward direction from the top of the other of said opposed side regions to the bottom region to separate said other of said opposed side regions from adjacent regions of said sheet member, at least one of said two fastening devices also being openable in a region for fastening and separating the top region of the panel to and from adjacent regions of the sheet member, whereby the panel section can be at least partially separated from adjacent regions of the sheet member.

18. The curtain of claim 17 wherein said two fastening devices are zipper members.

19. The curtain of claim 17, wherein said opposed side regions and top region are linear regions defining a generally inverted U-shaped configuration with the opposed linear side regions constituting the legs of the inverted U and the linear top region constituting the base of the inverted U, one of said fastening devices being a substantially linear member openable from one end of one of said linear side regions to the opposed end of said one of said linear side regions, and the other of two fastening devices being a substantially L-shaped member openable in both a first linear path along the linear top region and a second linear path along said other of said linear side regions.

20. The curtain of claim 19, wherein said fastening devices are zipper members and movement of said substantially linear zipper member fastening device along one linear side region in a direction from the top region downwardly separates the panel section from adjacent regions of the sheet member, and opening of the L-shaped zipper member fastening device in a direction across the top region and downwardly along said other linear side region separates the panel section from adjacent regions of the sheet member along the top region and said other linear side region of said panel sections.

21. A curtain particularly adapted for use in enclosing a front opening into a shower stall of the type having opposed side walls, a floor and omitting a low front sill or wall of the type that normally cooperates with a shower curtain or shower door to seal the front opening into the shower stall, said curtain including a flexible sheet member having a transversely extending upper edge and opposed elongate side edges, said flexible sheet member being attachable in an upper region adjacent the upper edge to an upper supporting member adjacent the front opening into the shower stall for movement between an extended, generally planar orientation closing the front opening and a collapsed, generally folded orientation permitting access into the shower stall through the front opening, said flexible sheet member including a front panel and elongate side regions adjacent the elongate side edges on opposed sides of said front panel, said elongate side regions including fastening members along an elongate section thereof for cooperating with fastening members on the opposed side walls of the shower stall to close opposed sides of the front opening, weights disposed transversely along a lower region of the sheet member, said sheet member including a lower bottom panel spaced below the weights to aid in preventing water from exiting the shower stall, said front panel of said flexible sheet member including a panel section that can be at least partially separated from adjacent regions of said sheet member to provide communication between the inside and outside of a shower stall when the curtain is in an extended, generally planar orientation closing the front opening into the shower stall.

22. The curtain of claim 21, wherein the panel section is connected to adjacent regions of the sheet member by at least one fastening device that is operable both to secure the panel section to adjacent regions of the sheet member and to at least partially separate the panel section from said adjacent regions of said sheet member.

23. The curtain of claim 22, including two fastening devices, both of said fastening devices being zipper members.

24. The curtain of claim 23, wherein the panel section can be separated from adjacent regions of said sheet member along opposed side regions and a top region of said panel section, said panel section including a bottom region permanently joined to said sheet member, one of said zipper members being moveable in a downward direction from the top of one of said opposed side regions to the bottom region to separate said one of said opposed side regions from adjacent regions of said sheet member and the other of said zipper members being moveable in a downward direction from the top of the other of said opposed side regions to the bottom region to separate said other of said opposed side regions from adjacent regions of said sheet member, at least one of said zipper members also being moveable into a region for fastening the top region of the panel section to adjacent regions of the sheet member and for separating the top region of the panel section from adjacent regions of the sheet member, whereby said zipper members can at least partially separate the panel section from adjacent regions of the sheet member along the opposed side regions and top region of said panel section.

25. The curtain of claim 24, wherein said opposed side regions and top region are linear regions defining a generally inverted U-shaped configuration with the opposed linear side regions constituting the legs of the inverted U and the linear top region constituting the base of the inverted U, one of said zipper members being a substantially linear member moveable in opposite linear directions from each end of one of said linear side regions to the opposed end of said one of said linear side regions, and the other of said two zipper members being a substantially L-shaped member moveable in opposite linear directions in both a first linear path along the linear top region and a second linear path along said other of said linear side regions.

26. The curtain of claim 25, wherein movement of said substantially linear zipper member along one linear side region in a direction from the top region downwardly separates the panel section from adjacent regions of the sheet member, and movement of the L-shaped zipper member in a direction across the top region and downwardly along said other linear side region separates the panel section from adjacent regions of the sheet member along the top region and said other linear side region of such panel section.

* * * * *

UNITED STATES PATENT AND TRADEMARK OFFICE

CERTIFICATE OF CORRECTION

PATENT NO. : 6,336,232 B1
DATED : January 8, 2002
INVENTOR(S) : Toder

It is certified that error appears in the above-identified patent and that said Letters Patent is hereby corrected as shown below:

Column 1,
Line 3, before "BACKGROUND OF THE INVENTION" insert

-- Field of the Invention

This invention relates generally to a shower curtain, and more particularly to a shower curtain that is particularly adapted for use in sealing the front opening into a shower stall of the type that does not include a low front wall, or sill. --

Signed and Sealed this

Twenty-third Day of July, 2002

*Attest:*

*Attesting Officer*

JAMES E. ROGAN
*Director of the United States Patent and Trademark Office*